US010361048B2

(12) United States Patent
von zur Muehlen et al.

(10) Patent No.: US 10,361,048 B2
(45) Date of Patent: Jul. 23, 2019

(54) PYROTECHNIC CIRCUIT PROTECTION SYSTEMS, MODULES, AND METHODS

(71) Applicant: EATON INTELLIGENT POWER LIMITED, Dublin OT (IE)

(72) Inventors: Patrick Alexander von zur Muehlen, Wildwood, MO (US); Michael Craig Henricks, Ballwin, MO (US); Joseph James Ventura, Eureka, MO (US)

(73) Assignee: EATON INTELLIGENT POWER LIMITED, Dublin (IE)

( * ) Notice: Subject to any disclaimer, the term of this patent is extended or adjusted under 35 U.S.C. 154(b) by 0 days.

(21) Appl. No.: 15/151,680

(22) Filed: May 11, 2016

(65) Prior Publication Data

US 2017/0330714 A1 Nov. 16, 2017

(51) Int. Cl.

| | |
|---|---|
| ***H01H 39/00*** | (2006.01) |
| ***H01R 24/76*** | (2011.01) |
| ***H01H 9/02*** | (2006.01) |
| *H01H 9/10* | (2006.01) |

(52) U.S. Cl.

CPC ..... *H01H 39/00* (2013.01); *H01H 9/02* (2013.01); *H01H 39/006* (2013.01); *H01R 24/76* (2013.01); *H01H 9/106* (2013.01)

(58) Field of Classification Search

CPC ..... H01H 37/76; H01H 39/00; H01H 85/00; H01H 9/22; H01J 61/54; H05B 41/02; H05B 41/06

USPC ..... 337/30, 401, 414; 200/50.02

See application file for complete search history.

(56) References Cited

U.S. PATENT DOCUMENTS 4,944,697 A * 7/1990 Dorman ..... H01H 85/0417 337/255
6,204,747 B1 * 3/2001 Kitchens ..... H01H 37/761 337/407
2005/0040252 A1 * 2/2005 Thomann ..... F41H 9/06 239/302

(Continued)

FOREIGN PATENT DOCUMENTS

DE 10049071 A1 * 4/2002 ..... H01H 39/006
DE 102009023801 A1 * 2/2010 ..... H01H 85/0241

(Continued)

OTHER PUBLICATIONS

Virgin Jean-Marc, Kablaoui Hassan, "Safety device for disconnecting high voltage battery in e.g. electric vehicle from electric circuit during short circuit, has safety fuse connected parallel to pyrotechnical fuses, and series resistor connected upstream to safety fuse", Feb. 4, 2010, Daimler AG, Entire Document (Translation of DE102009023801).*

(Continued)

*Primary Examiner* — Anatoly Vortman
*Assistant Examiner* — Stephen S Sul
(74) *Attorney, Agent, or Firm* — Armstrong Teasdale LLP

(57) ABSTRACT

A pyrotechnic circuit protection system includes a first connection terminal, a second connection terminal and a plurality of pyrotechnic modules connected between the first and second connection terminals. Each of the pyrotechnic modules includes a nonconductive housing and electrical connectors facilitating plug-in connection of the pyrotechnic modules to one another. A single control module may control and coordinate a plurality of pyrotechnic disconnect modules.

21 Claims, 10 Drawing Sheets

(56) References Cited

U.S. PATENT DOCUMENTS

| | | | | |
|---|---|---|---|---|
| 2005/0190525 | A1* | 9/2005 | Jennings, III | F42D 1/055 361/247 |
| 2006/0049027 | A1* | 3/2006 | Iversen | H01H 39/006 200/61.8 |
| 2007/0063808 | A1* | 3/2007 | Darr | H01H 9/104 337/143 |
| 2008/0137253 | A1* | 6/2008 | George | H01H 9/106 361/93.1 |
| 2009/0315664 | A1* | 12/2009 | Crane | H01H 9/44 337/227 |
| 2012/0127621 | A1* | 5/2012 | Knapp, Jr. | H02H 3/093 361/94 |
| 2013/0207769 | A1* | 8/2013 | Faltermeier | H01H 85/24 337/290 |
| 2016/0189905 | A1* | 6/2016 | Lanning | H01H 85/143 337/159 |
| 2016/0225558 | A1* | 8/2016 | Chatroux | H01H 39/004 |

FOREIGN PATENT DOCUMENTS

| | | | | |
|---|---|---|---|---|
| DE | 20201004061 | U1 | 6/2010 | |
| DE | 202010004061 | U1 * | 7/2010 | |
| DE | 102011014343 | A1 * | 9/2012 | B60L 3/0007 |
| DE | 102012022083 | A1 | 5/2014 | |
| EP | 2293345 | A2 | 3/2011 | |
| FR | 3014594 | A1 | 6/2015 | |
| GB | 2489101 | A | 9/2012 | |

OTHER PUBLICATIONS

Bornhorst Dieter et.al., "Circuit protection device, especially in vehicles, has terminals protruding out of housing formed in one piece with conducting section inside housing forming preferred breakage point", Apr. 25, 2002, MICRONAS GMBH, Entire Document (Translation of DE10049071).*

"Elektrisch koppelbares Installationsgerät", Jun. 24, 2010, THEBEN AG, Entire Document (Translation of DE202010004061).*

Tautz Juergen, "Pyrotechnically actuated fuse for a motor vehicle", Sep. 20, 2012, GM Global Tech Operations INC, Entire Document (Translation of DE102011014343).*

International Search Report and Written Opinion for International Application No. PCT/US2817029547, dated Jul. 24, 2017, 16 pages.

Extended European Search Report for Application No. 17170514.8, dated Jul. 24, 2017, 9 pages.

* cited by examiner

PYROTECHNIC CIRCUIT PROTECTION SYSTEMS, MODULES, AND METHODS

BACKGROUND OF THE INVENTION

The field of the invention relates generally to electrical circuit protection devices and related systems and methods, and more specifically to pyrotechnic circuit protection devices and related systems and methods.

Pyrotechnic circuit protection devices are known that include terminals for connection to a circuit and a pyrotechnic disconnect feature that releases energy to disconnect the terminals inside the device. The pyrotechnic disconnect feature may include stored chemical, electrical or mechanical energy that is released via actuation of a pyrotechnic charge to sever an electrical connection between the terminals of the device. As such, pyrotechnic circuit protection devices are sometimes referred to as pyrotechnic disconnects or pyrotechnic switches. Once activated, such devices can electrically isolate load-side circuitry from line-side circuitry through the pyrotechnic circuit protection device when predetermined fault conditions occur in the line-side circuitry and prevent possible damage to load-side circuitry that the fault condition may otherwise present.

Pyrotechnic circuit protection devices are advantageous for their quick and reliable operation regardless of the energy (voltage and current) in the circuit completed through the device when fault conditions are identified. This is because the energy needed to open the device comes from a chemically stored source in the pyrotechnic unit rather than the energy of the circuit fault (as in fusible circuit protector) or from stored mechanical energy (as in conventional circuit breaker devices).

Known pyrotechnic circuit protection devices remain disadvantaged in some aspects, however, that to date have limited their use to a relatively small set of niche applications. Improvements are desired.

BRIEF DESCRIPTION OF THE DRAWINGS

Non-limiting and non-exhaustive embodiments are described with reference to the following Figures, wherein like reference numerals refer to like parts throughout the various views unless otherwise specified.

DETAILED DESCRIPTION OF THE INVENTION

Figure 1:
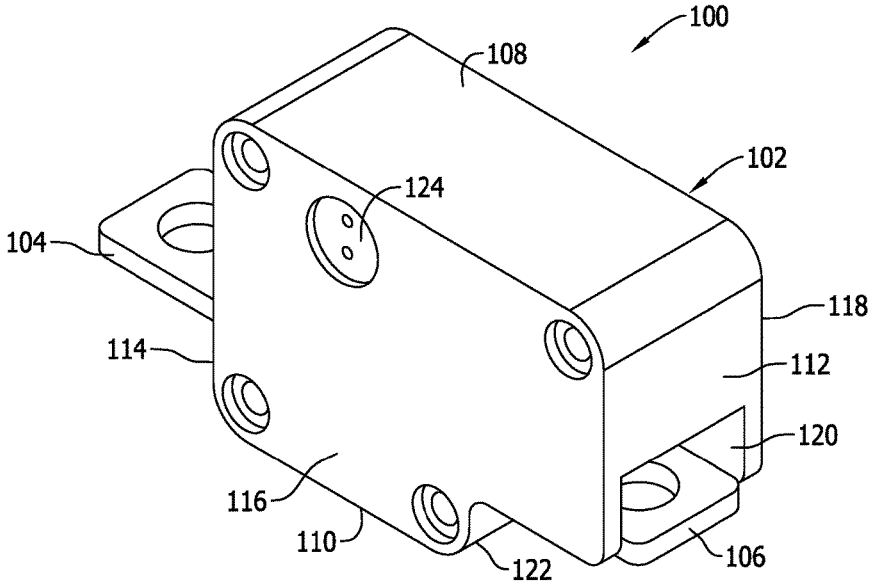
FIG. 1 is a first perspective view of an exemplary embodiment of a pyrotechnic circuit protection module according to the present invention.

In order to understand the present invention to its fullest extent, a discussion of the state of the art of pyrotechnic circuit protection devices and its limitations is described below, followed by a discussion of exemplary embodiments of the present invention that address and overcome those limitations and beneficially satisfy longstanding and unfulfilled needs in the art.

Conventional pyrotechnic circuit protection devices tend to be disadvantaged in certain aspects that have until now been an impediment to their widespread use and adoption. Instead, conventional pyrotechnic circuit protection device tend to be employed only in certain niche applications.

For example, known pyrotechnic circuit protection devices tend to be limited to relatively low voltage applications (typically 70V or less) and relatively low current applications (typically 100 A or less). For voltage and current applications outside this range, conventional pyrotechnic circuit protection devices are generally not considered.

Pyrotechnic circuit protection devices require an external actuation source and a monitoring system to detect fault conditions and activate the pyrotechnic disconnect feature. Providing actuation sources and monitoring systems and connecting them to the pyrotechnic circuit protection devices can be impractical and inconvenient relative to other types of circuit protection devices. Such issues are multiplied over the number of pyrotechnic circuit protection devices needed to protect desired circuitry.

Conventional pyrotechnic circuit protection devices generally do not include arc mitigation elements, so for higher voltage systems another circuit protection device (typically a fuse) is often used in parallel to a pyrotechnic circuit protection device. This increases the cost and expense of implementing pyrotechnic circuit protection devices, and is multiplied over the number of pyrotechnic circuit protection devices needed to protect desired circuitry.

Finally, pyrotechnic circuit protection devices tend to be expensive to develop for specific applications, and are not compatible with existing circuit protection accessories such as fuse holders, fuse blocks, etc. that accommodate fuses and facilitate ease of connection to electrical circuits. Without a great deal of effort and analysis to determine the correspondence between pyrotechnic circuit protection devices and other circuit protection devices they are not easy to use as a drop-in replacement to other types of circuit protectors such as fuses.

Exemplary embodiments of the present invention are described below that beneficially overcome these and other disadvantages in the art. As explained in detail below, modular pyrotechnic circuit protection devices are proposed for use in combination with modular pyrotechnic control modules that provide an easily configurable system that may be readily used with standard fuses, terminals, controllers and other components to meet a wide variety of circuit protection specifications and needs at relatively low cost and with general compatibility with established circuit protection fuse classes and related devices. Method aspects will be in part apparent and in part explicitly discussed in the description below.

Figure 2:
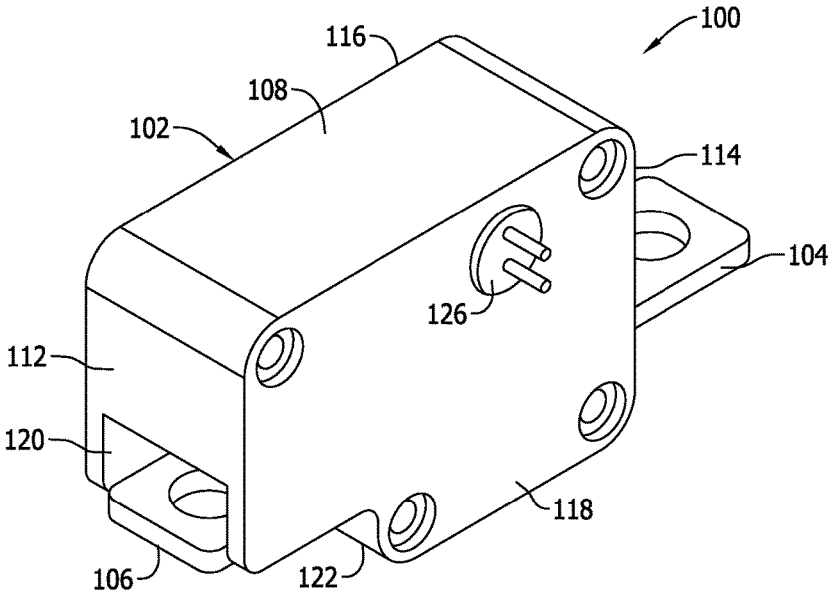
FIG. 2 is a second perspective view of the pyrotechnic circuit protection module shown in FIG. 1.

FIGS. 1 and 2 are perspective views of an exemplary embodiment of a pyrotechnic circuit protection module, referred to herein as a pyrotechnic disconnect module 100 according to the present invention. The pyrotechnic disconnect module 100 generally includes a nonconductive housing 102 and first and second terminals 104, 106 extending from and exposed on opposing sides of the housing 102. The terminals 104, 106 provide a connection structure to external circuitry, and in the example shown the terminals 104, 106 are flat terminals including a mounting aperture that may provide, for example, connections to terminal studs of a power distribution block, or bolt-on connection to a another conductor. Other types of terminals known in the art may likewise be used instead in other alternative embodiments. Also, in other embodiments, the terminals 104, 106 instead of being the same type as in the example shown may be different types relative to one another. It is also understood that in another embodiment the terminals 104, 106 may project from or be exposed by other locations in the housing 102, including but not limited to an embodiment wherein the terminals 104, 106 extend from the same side of the housing 102.

In the example shown, the housing 102 has a generally rectangular shaped outer profile defined by a top face or surface 108, a bottom face or surface 110 opposing the top surface 108, lateral side faces or surfaces 112, 114, and longitudinal side faces or surfaces 116, 118. A recess 120 is formed adjacent the terminal 106 on the lateral surface 112 and a portion of the housing 102 overhangs the terminal 106 on the lateral side 112, while a clearance or cutout 122 is formed in the housing 102 beneath the terminal 106 on the lateral side 112. The terminal 104, however, projects away from the housing at the opposing side without an overhang or cutout formed in the housing 102 at the lateral side 114. The housing 102 accordingly has an asymmetrical shape in the example shown. Other geometric shapes and geometries, including symmetrical shapes, are possible in other embodiments.

As also shown in FIGS. 1 and 2, the longitudinal sides 116, 118 of the pyrotechnic disconnect module 100 each include respective electrical connectors 124, 126 exposed thereon. In the example shown, the connector 124 is a female connector and the connector 126 is a male connector. The connectors 124, 126 in the illustrated example, generally oppose one another and are in-line with one another in the same location vis-à-vis the opposing sides 116, 118 of the pyrotechnic disconnect module 100. That is, the connectors 124, 126 are located at the same elevation and spacing from the respective sides 108, 114 of the housing 102. As such, aligned pyrotechnic disconnect modules 100 can be electrically connected to one another via the male connector 126 on a first pyrotechnic disconnect module 100 and a female connector 124 on a second pyrotechnic disconnect module 100 using a plug and socket-type engagement.

When the respective electrical connectors 124, 126 of two adjacent pyrotechnic disconnect modules 100 are joined and mated as in the example systems described below, electrical interconnection of the pyrotechnic disconnect modules 100 is established for control and coordination purposes described below in a pyrotechnic circuit protection system. While exemplary male and female connectors 126, 124 are shown at exemplary locations in the pyrotechnic disconnect 100 and also while a two prong male connector 126 and a two aperture female connector 124 are provided, other types of male and female connectors 126 may be utilized in other embodiments, whether in the same or different locations on the housing 102, in other embodiments.

The electrical connector 124 and 126 in each pyrotechnic module 100 is electrically connected via the first male prong and the first mating aperture to a pyrotechnic disconnect element 128 (FIG. 5) inside the module housing 102. The pyrotechnic disconnect element 128 may be activated by control circuitry in the manner described below to release stored energy inside the module 100 in a known manner to open or disconnect a conductive circuit path between the terminals 104, 106 in a known manner. Generally, any known type of pyrotechnic element 128 and associated type of energy storage element (e.g., chemical, electrical, mechanical) known in the art may be utilized inside the pyrotechnic disconnect module 100.

A power supply and electronic control circuit 130 (FIG. 5) may also be included in the pyrotechnic disconnect module 100. When a trigger command is received by the control circuit 130 via one of the connectors 124, 126 the pyrotechnic element 128 is activated by the power supply to cause the energy to be released that, in turn, opens or disconnects the terminals 104, 106 of the module 100.

The control circuitry of the module 100 may include a processor-based microcontroller including a processor and a memory storage wherein executable instructions, commands, and control algorithms, as well as other data and information required to satisfactorily operate as described are stored. The memory of the processor-based device may be, for example, a random access memory (RAM), and other forms of memory used in conjunction with RAM memory, including but not limited to flash memory (FLASH), programmable read only memory (PROM), and electronically erasable programmable read only memory (EEPROM).

As used herein, the term "processor-based" microcontroller shall refer not only to controller devices including a processor or microprocessor as shown, but also to other equivalent elements such as microcomputers, programmable logic controllers, reduced instruction set (RISC) circuits, application specific integrated (ASIC) circuits and other programmable circuits, logic circuits, equivalents thereof, and any other circuit or processor capable of executing the functions described herein. The processor-based devices listed above are exemplary only, and are thus not intended to limit in any way the definition and/or meaning of the term "processor-based".

The power supply for the control circuit 130 in contemplated embodiments may be line voltage (either separately supplied or derived from the circuitry protected with the pyrotechnic circuit protection module 100), an isolated power supply, or may employ one or more power harvesting supplies. Potential power sources and supplies in contemplated embodiments also include the use of power resistors to limit AC line voltage, rectified AC line voltages, voltage regulators, voltage drops across Zener diodes, voltage drop across power capacitors or supercapacitors, and/or a battery power supply or battery bank. Renewable energy sources such as solar power and wind power may also be utilized.

A pass through electrical connection is also established in the housing 102 via the connectors 124 and 126 of each pyrotechnic disconnect module 100 for the purposes described below. A number of pyrotechnic disconnect modules 100 may therefore be electrically connected to one another in a daisy chain arrangement vis the connectors 124, 126 provided, and a continuity check can be made through the connected string of pyrotechnic disconnect modules 100 to verify and account for all connected pyrotechnic disconnect modules 100 via the second prong and the second aperture in the connectors 126 and 124. Activation signals may be sent via the connectors 124, 126 from a control module described below to activate the pyrotechnic disconnect element 128 in each module 100 individually in an independent manner, or to activate the respective pyrotechnic elements 128 in the connected modules 100 simultaneously as desired.

Figure 3:
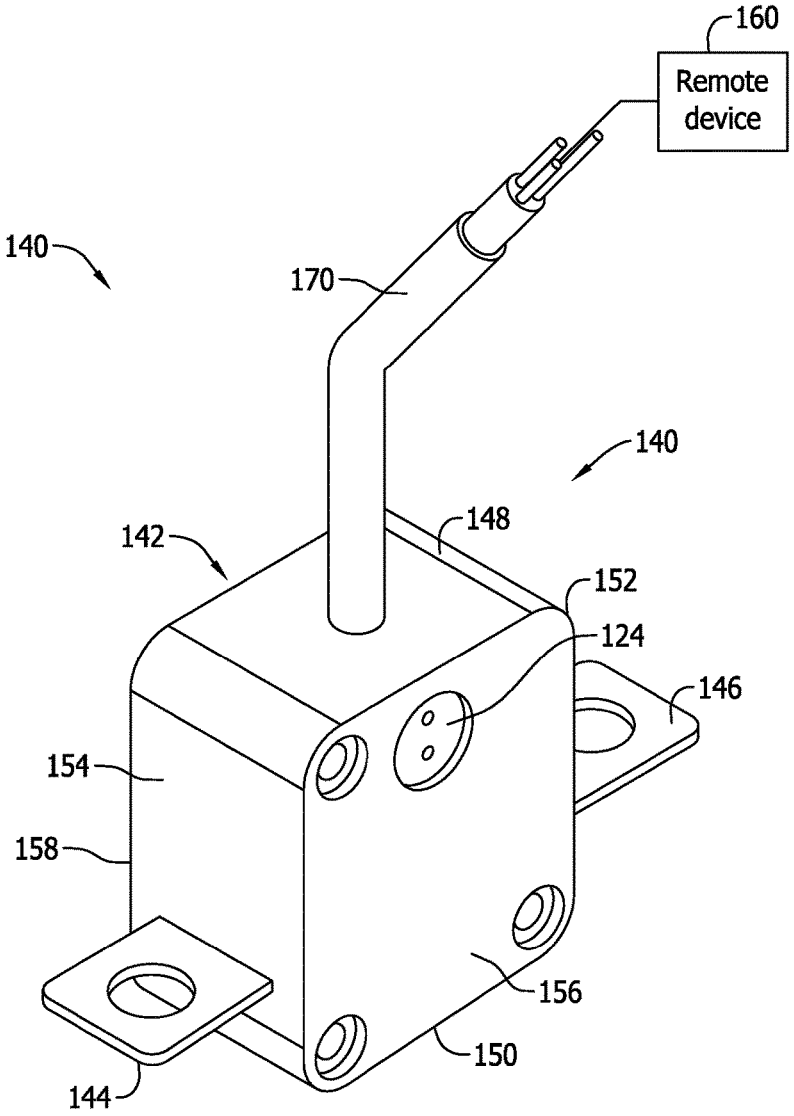
FIG. 3 is a perspective view of an exemplary embodiment of a pyrotechnic control module for use with the pyrotechnic circuit protection device module in FIGS. 1 and 2 according to the present invention.

FIG. 3 is a perspective view of an exemplary embodiment of a modular pyrotechnic control module 140 for use with the pyrotechnic circuit protection device module(s) 100 (FIGS. 1 and 2).

The pyrotechnic control module 140 generally includes a nonconductive housing 142 and first and second terminals 144, 146 extending from and exposed on opposing sides of the housing 142. The terminals 144, 146 provide a connection structure to external circuitry, and in the example shown the terminals 144, 146 are flat terminals including a mounting aperture that may provide, for example, connections to terminal studs of a power distribution block, or bolt-on connection to a another conductor. The terminals 144, 146 are similar to the terminals 104, 106 of the pyrotechnic disconnect module 100 described above. Other types of terminals known in the art may likewise be used instead in other alternative embodiments, and the terminal structure in the pyrotechnic control module 140 need not be the same as the terminal structure in the pyrotechnic disconnect module (s) 100 in all embodiments. Also, in other embodiments, the terminals 144, 146 instead of being the same type as in the example shown may be different types relative to another. It is also understood that in another embodiment the terminals 144, 146 may project from or be exposed by other locations in the housing 142 of the module 140, including but not limited to an embodiment wherein the terminals 144, 146 extend from the same side of the housing 142.

In the example shown, the housing 142 of the pyrotechnic control module 140 has a generally rectangular shaped outer profile defined by a top face or surface 148, a bottom face or surface 150 opposing the top surface 148, lateral side faces or surfaces 152, 154, and longitudinal side faces or surfaces 156, 158. Unlike the housing 102 of the pyrotechnic disconnect module 100, the housing 142 of the pyrotechnic control module 140 has a symmetrical shape in the example shown. The sides 156, 158 of the control module housing 142 are generally square sides having edges of approximately equal length, whereas the sides 116, 118 of the pyrotechnic disconnect module housing 102 include side edges of substantially different length. Other geometric shapes and geometries, including asymmetrical shapes of the control module 140, are possible in other embodiments. It is noted that the shape and profile of the pyrotechnic control module 140 is visibly different from the pyrotechnic circuit protection module 100 (FIGS. 1 and 2) in both shape and proportion so that the two pyrotechnic modules 100, 140 can be readily identified and distinguished in use. Beneficially, the two modules 100, 140 cannot easily be mistaken for one another in assembling the modules into a system such as those described below.

The pyrotechnic control module 140 includes an electrical connector in the form of a two aperture female connector 124 on one of the lateral sides 156, 158 of the housing 142. The connector 124 is located at the same elevation as the corresponding connector 124 in the pyrotechnic disconnect module 100. Using the connector 124, the control module 140 may be aligned side-by-side with and be connected to a pyrotechnic circuit protection module 100 via the connector 126 of the module 100 to configure a pyrotechnic circuit protection system as further described below. The control module 140, however, may alternatively include the male connector 126 instead of the female connector 124 in the embodiment shown. Further, in still another embodiment the control module 140 could include male and female connectors on opposing sides thereof, either of which could be connected to one of the pyrotechnic circuit protection modules 100.

The control module 140 may be a processor-based device communicating with a remote device 160 via a wire or cable 170. The remote device 160 may input signals to the control module 140 or may be responsive to output signals from the control module 140. The control module 140 may include a processor-based microcontroller including a processor and a memory storage wherein executable instructions, commands, and control algorithms, as well as other data and information required to satisfactorily operate as described. The memory of the processor-based device may be, for example, a random access memory (RAM), and other forms of memory used in conjunction with RAM memory, including but not limited to flash memory (FLASH), programmable read only memory (PROM), and electronically erasable programmable read only memory (EEPROM).

As used herein, the term "processor-based" microcontroller shall refer not only to controller devices including a processor or microprocessor as shown, but also to other equivalent elements such as microcomputers, programmable logic controllers, reduced instruction set (RISC) circuits, application specific integrated (ASIC) circuits and other programmable circuits, logic circuits, equivalents thereof, and any other circuit or processor capable of executing the functions described herein. The processor-based devices listed above are exemplary only, and are thus not intended to limit in any way the definition and/or meaning of the term "processor-based".

The remote device 160 in one embodiment may be a monitoring system that in a known manner detects electrical fault conditions (e.g., electrical overcurrent conditions) in the circuitry connected to one or more of the pyrotechnic circuit protection modules 100. The monitoring system in such a scenario may be a separately provided processor-based device in communication with voltage sensors, current sensors or other sensors for detecting electrical fault detections. Other possible sensors for detection of fault conditions may include thermal sensors, vibration sensors, pressure sensors, acoustic sensors, fluid sensors, and light sensors. Signal inputs from one or more sensors such as those above may be received and compared by the monitoring system to predetermined trigger command set points or thresholds to determine whether or not to activate a pyrotechnic circuit protection module 100. If inputs from the sensors are below the applicable thresholds no fault conditions are determined to exist and the signal inputs will continue to be monitored. On the other hand, as inputs from the sensors reach or exceed the applicable thresholds, electrical fault conditions are determined to exist and trigger commands may be sent from the monitoring system 160 to the control module 140 via the cable 170. The control module 140 may then communicate the trigger signal to the affected pyrotechnic circuit protection module(s) 100.

In another contemplated embodiment, the comparison(s) of sensed values to trigger set point values may be made by the control module 140 itself based on supporting data from the remote device 160, or still alternatively based upon its own sensing or monitoring capability. For instance, the pyrotechnic control module 140 may monitor electrical conditions sensed across another element in the circuit (e.g., one or more electrical fuses such as the fuse 208 (FIGS. 4 and 5)), and based on the monitored conditions make the comparison to predetermined trigger set points and when necessary issue trigger commands. Various different techniques of monitoring circuit conditions across a fuse using voltage and current sensing circuitry to detect electrical fault conditions are known and may be utilized by the pyrotechnic control module 140.

Once electrical fault conditions are determined as described above, whether by the control module 140 itself or by the remote device 160, the control and actuation module 140 sends an activation signal to one or more of the pyrotechnic circuit protection modules 100 so that disconnection through the pyrotechnic circuit protection module(s) 100 can be effected to protect connected circuitry on the load side. Notification signals or messages can be sent from the pyrotechnic control module 140 to the remote device 160 so that further appropriate actions can be taken in response to the pyrotechnic disconnections made, including but not limited to generation of notices or alerts to responsible personnel so that the circuitry may be restored by replacing the activated and opened pyrotechnic disconnection modules.

To summarize, and in view of the above, in contemplated embodiments, electrical fault detection and determination may be undertaken externally by the remote device 160, may be undertaken by another device or system and communicated to the control module 140 by the remote device 160, may be detected and determined by the control module 140 itself, or in some cases, trigger command signals may also be generated manually or programmed by another system or equipment associated with the electrical power system. As such, the control module 140 may be responsive to actions taken by a person or other equipment in a proactive manner, regardless of whether or not fault conditions may actually be present at the pyrotechnic disconnect module 100.

To facilitate communication between the control module 140 and an external device 160, the wire or cable 170 in contemplated embodiments may include a ground conductor to support control electronics in the remote device 160 and/or in the control module 140. The cable 170 may also include an input signal conductor for communication of command signals and data to the control module 140 as well as test and diagnostic signals on the same signal wire or an additional signal wire in the cable 170. When trigger command signals are received by the control module 140 over the cable 170, the control module 140 can output trigger command signals to one or more of the connected pyrotechnic circuit protection modules 100 via the connector 124 of the control module 140. As such, a single control module 140 may coordinate and control a plurality of pyrotechnic circuit protection modules 100, as well as communicate with the remote device 160.

The control module 140 in contemplated embodiments may be powered by line voltage (either separately supplied or derived from the circuitry protected with the pyrotechnic circuit protection modules 100), an isolated power supply, or by utilizing known power harvesting technologies. Potential power sources and supplies in contemplated embodiments also include the use of power resistors to limit AC line voltage, rectified AC line voltages, voltage regulators, voltage drops across Zener diodes, voltage drop across power capacitors or supercapacitors, and/or a battery power supply or battery bank. Renewable energy sources such as solar power and wind power may also be utilized.

Figure 4:
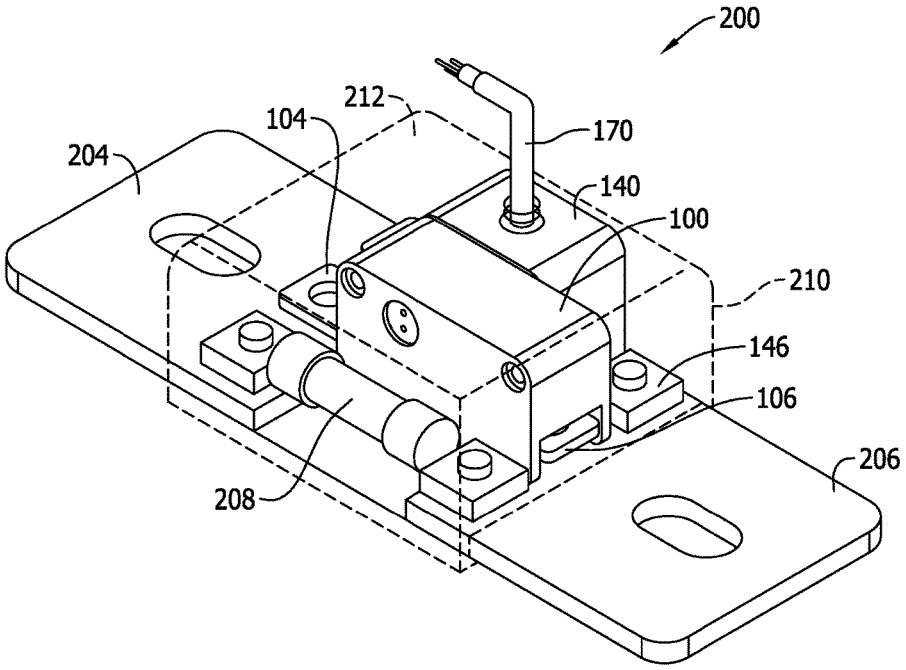
FIG. 4 is a perspective view of a first exemplary embodiment of a pyrotechnic circuit protection system according to the present invention including the pyrotechnic circuit protection module of FIGS. 1 and 2 and the pyrotechnic control module shown in FIG. 3.
Figure 5:
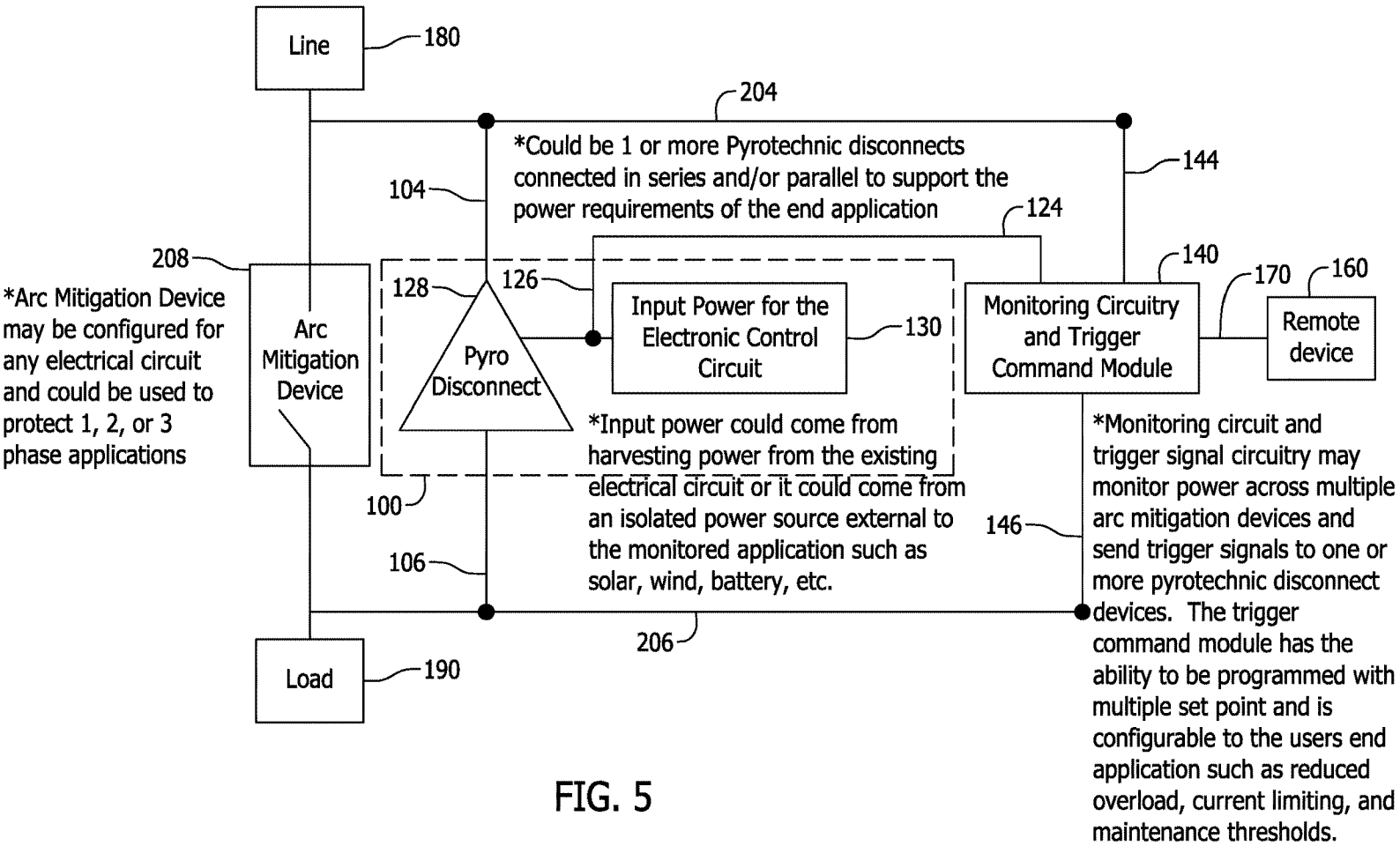
FIG. 5 is a block diagram of the exemplary system shown in FIG. 4.

FIG. 4 is a perspective view of a first exemplary embodiment of pyrotechnic circuit protection system 200 according to the present invention, and FIG. 5 is a block diagram of the system 200. The system 200 as shown includes one pyrotechnic disconnect module 100 and one pyrotechnic control module 140. The modules 100 and 140 are positioned side-by-side and are mechanically and electrically interconnected by the respective female connector 124 (FIG. 3) of the module 140 and the male connector 126 (FIG. 2) of the module 100 with plug-in connection. Bus bars 204, 206 are connected to the terminals 106, 104 of the module 100 and to the terminals 144, 146 of the module via bolt connections, and the bus bars 204, 206 may in turn be connected to external circuitry in a similar manner. As seen in FIG. 5, the bus bar 204 may be connected to line-side or power supply circuitry 180, and the bus bar 206 may be connected to load-side circuitry 190. In other embodiments terminals other than bus bars may be utilized to make such connections, including terminal screw connectors, soldered connections, brazed connections or other connection techniques known in the art using known fasteners and the like.

The system 200 also includes a high voltage, low amperage fuse 208 for arc quenching purposes when the pyrotechnic circuit protection module 100 is activated to disconnect or open an electrical connection between the terminals 104, 106. The fuse 208 is connected to the bus bars 204, 206 via terminal elements similar to those shown for the modules 100, 140. The fuse 208 establishes a current path in electrical parallel to the pyrotechnic circuit protection module 100. When the circuit path between the terminals 104, 106 of the pyrotechnic circuit protection module 100 is opened, current is then diverted through the fuse 208. The fuse 208 includes an arc extinguishing media or other arc quenching feature to dissipate electrical arcing potential inside the fuse 208 as the fusible element therein opens. By this arrangement, the pyrotechnic circuit protection module 100 need not itself include arc mitigation features.

In normal operation, when no electrical fault condition exists, the pyrotechnic circuit protection module 100 provides a low resistance circuit path between its terminals 104, 106. The fuse 208, however, exhibits a relatively higher electrical resistance, and as such very little current will flow through the fuse in normal conditions. Instead, almost all of the current in normal conditions will flow through the pyrotechnic circuit protection module 100. Depending on the circuitry being protected and its electrical arcing potential, the fuse 208 may in some instances be considered optional and may be omitted in the system 200.

A housing base 210 and housing cover 212 may be provided as shown to protect the components of the system 200 when interconnected as shown. The base 210 defines a receptacle sized and dimensioned to receive the modules 100, 140 and the arc mitigation fuse 208. The cover 212 in the example shown includes an aperture through which the cable 170 may pass. The cover 212 may in some embodiments be transparent. In other embodiments, the cover 212 may be color coded to convey to a person the type of disconnect modules 100 included without having to open the cover 212 for inspection. While an exemplary housing is shown and described, other variations of housings are possible and may be utilized as desired. In certain embodiments, the housing may be considered optional and may be omitted in the system 200.

Figure 6:
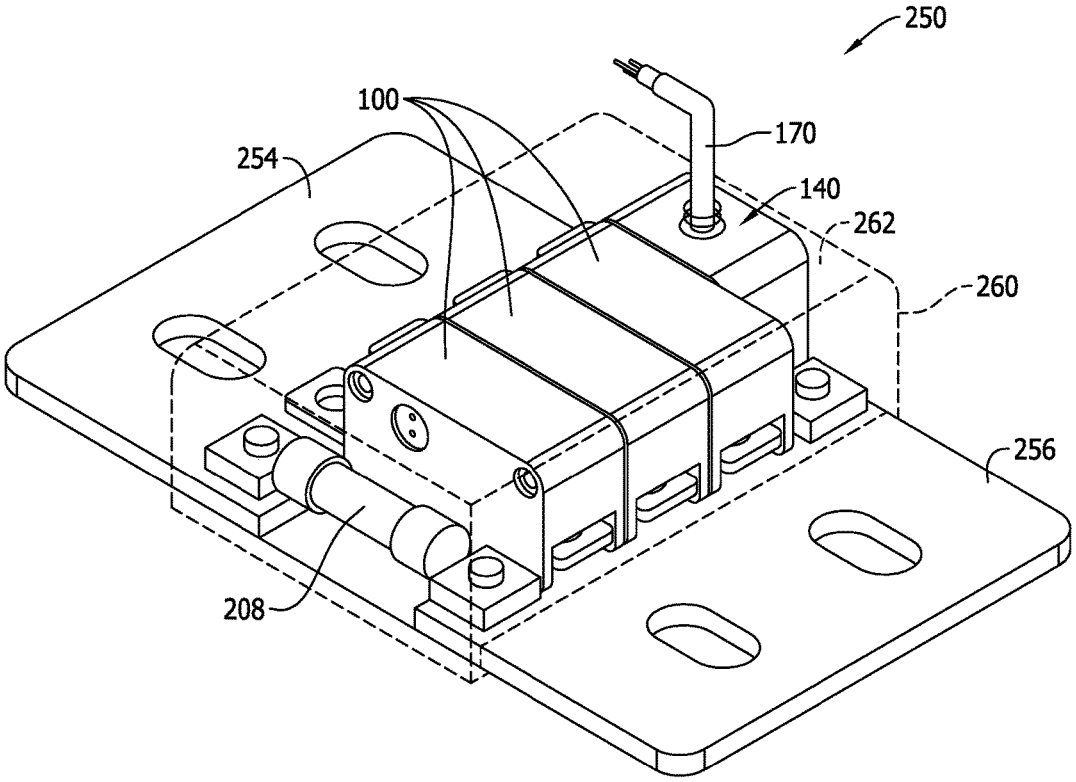
FIG. 6 is a perspective view of a second exemplary embodiment of a pyrotechnic circuit protection system according to the present invention including the pyrotechnic circuit protection modules of FIGS. 1 and 2 and the pyrotechnic control module shown in FIG. 3.

FIG. 6 is a perspective view of a second exemplary embodiment of a pyrotechnic circuit protection system 250 according to the present. The system 250 includes three pyrotechnic disconnect modules 100, a control module 140, and the optional arc mitigation fuse 208. The system 250 includes bus bar terminals 254, 256 that are larger than the bus bars 204, 206 of the system 200, but are otherwise similar.

The three pyrotechnic disconnect modules 100 are electrically connected one another and to the module 140 via the respective connectors 124, 126 described above. The three pyrotechnic disconnect modules 100 are electrically connected to one another in parallel between the bus bar terminals 254, 256 so that collectively they may accommodate a greater amount of current flowing between the bus bars 254, 256 than any individual one of the pyrotechnic disconnect modules 100 could handle. Compared to the system 200 (FIG. 4), the system 250 can accordingly operate with larger current input to achieve a higher amperage rating for the system 250.

As described above, either by itself or in response to an incoming signal from the cable 170, the pyrotechnic control module 140 may activate the pyrotechnic disconnect modules 100 independently or as a group. While three pyrotechnic disconnect modules 100 are shown, greater or fewer numbers of pyrotechnic disconnect modules 100 may be provided in further and/or alternative embodiments. The system 250 is also shown to include a housing base 260 and cover 262 that is larger than the housing base 210, 212 in the system 200, but otherwise is similar.

Figure 7:
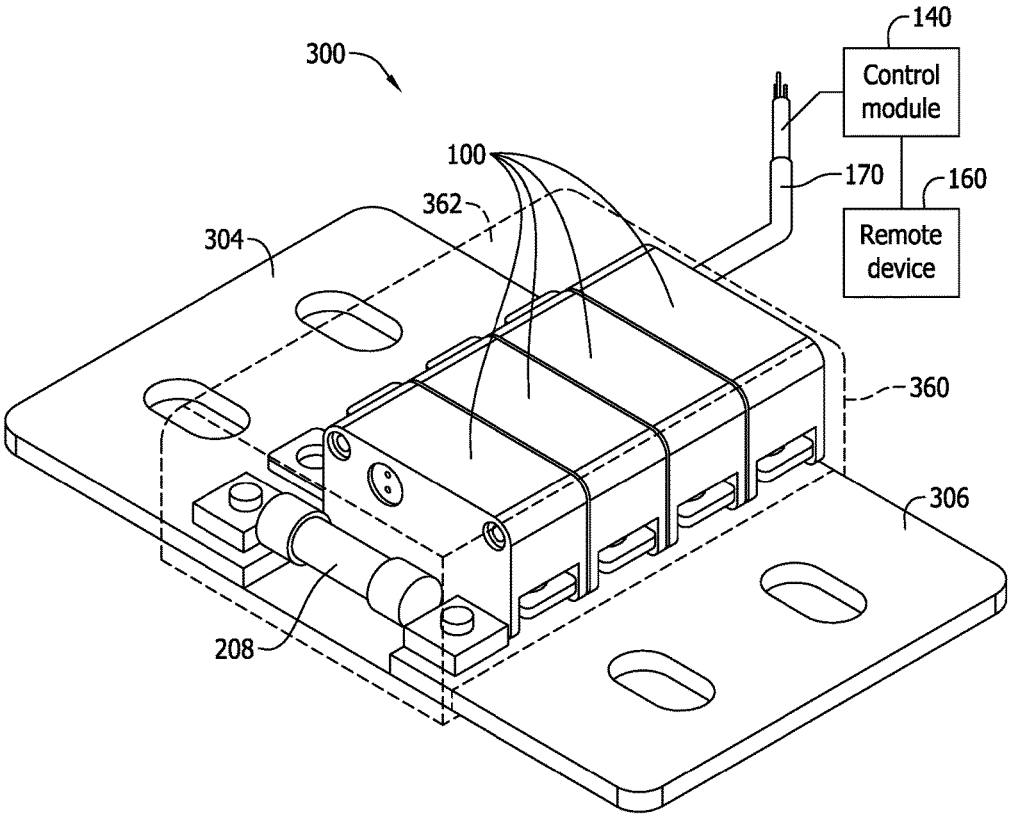
FIG. 7 is a perspective view of a third exemplary embodiment of a pyrotechnic circuit protection system according to the present invention including pyrotechnic circuit protection modules.

FIG. 7 is a perspective view of a third exemplary embodiment of pyrotechnic circuit protection system 300 according to the present invention.

The system 300 includes four pyrotechnic disconnect modules 100, and a control module 140 in communication with the pyrotechnic disconnect modules 100 via the cable 170. As such, the control module 140 may be located at a distance from the pyrotechnic disconnect modules 100. The cable 170 may be provided with corresponding connectors 124, 126 to plug the cable 170 into the pyrotechnic disconnect modules 100 on one end and to the pyrotechnic control module 140 on the other. The control module 140 may communicate with the remote device 160 via another cable 170. In some embodiments the remote device 160 could likewise be directly connected to the pyrotechnic disconnect modules 100 without utilizing the control module 140.

The system 300 also includes the optional arc mitigation fuse 208 for the same reasons previously explained. The system 300 includes bus bars terminals 304, 306 that are larger than the bus bars 254, 256 of the system 250, but are otherwise similar.

The four pyrotechnic disconnect modules 100 are electrically connected to one another via the respective connectors 124, 126 described above. The four pyrotechnic disconnect modules 100 are electrically connected to one another in parallel between the bus bar terminals 304, 306 so that collectively they may accommodate a greater amount of current flowing between the bus bars 304, 306 than any individual one of the pyrotechnic disconnect modules 100 could handle. Compared to the system 250 (FIG. 6), the system 300 can accordingly operate with larger current input to achieve a higher amperage rating for the system 300.

As described above, the pyrotechnic control module 140 and/or the remote device 160 may activate the disconnect elements 128 in the pyrotechnic disconnect modules 100 independently or as a group. While four pyrotechnic disconnect modules 100 are shown in FIG. 7, greater or fewer numbers of pyrotechnic disconnect modules 100 may be provided in further and/or alternative embodiments. The system 300 is also shown to include a housing base 360 and cover 362 that is larger than the housing base 210, 212 in the system 200, but otherwise is similar.

Figure 8:
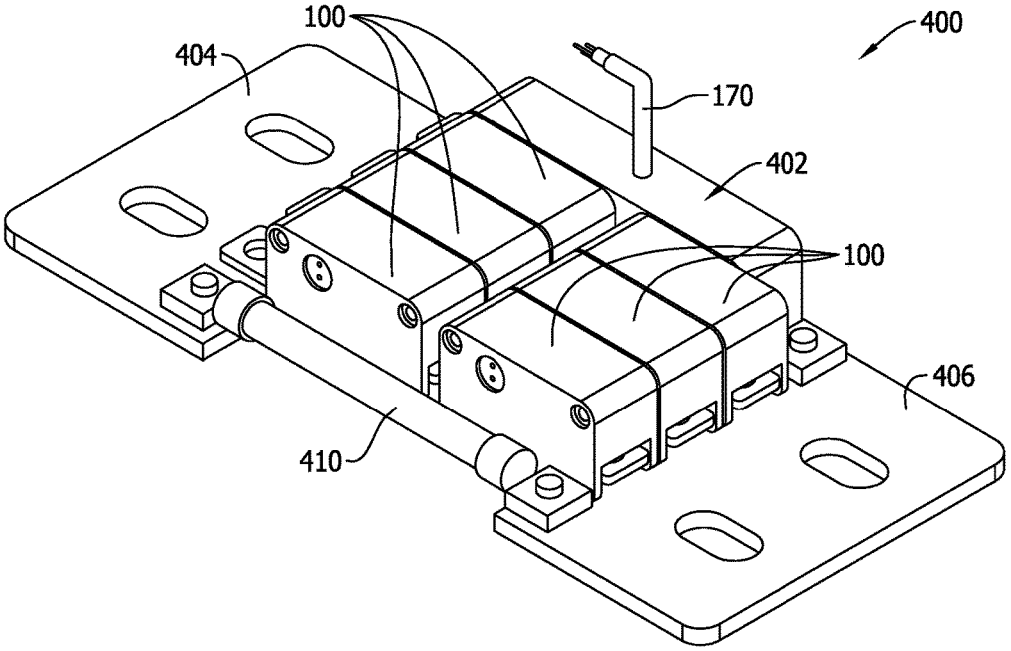
FIG. 8 is a perspective view of a fourth exemplary embodiment of a pyrotechnic circuit protection system according to the present invention including pyrotechnic circuit protection modules shown in FIGS. 1 and 2 with another exemplary embodiment of a pyrotechnic control module.

FIG. 8 is a perspective view of a fourth exemplary embodiment of pyrotechnic circuit protection system 400 according to the present invention including six pyrotechnic disconnect modules 100, and another exemplary embodiment of a pyrotechnic control module 402 in communication with the pyrotechnic disconnect modules 100 via the cable 170.

The six pyrotechnic disconnect modules 100 are shown to be connected in three pairs of series connected modules 100 between bus bar terminals 404, 406. This arrangement allows the system 400 to operate at higher voltages and/or to provide system redundancy and improved reliability.

Figure 9:
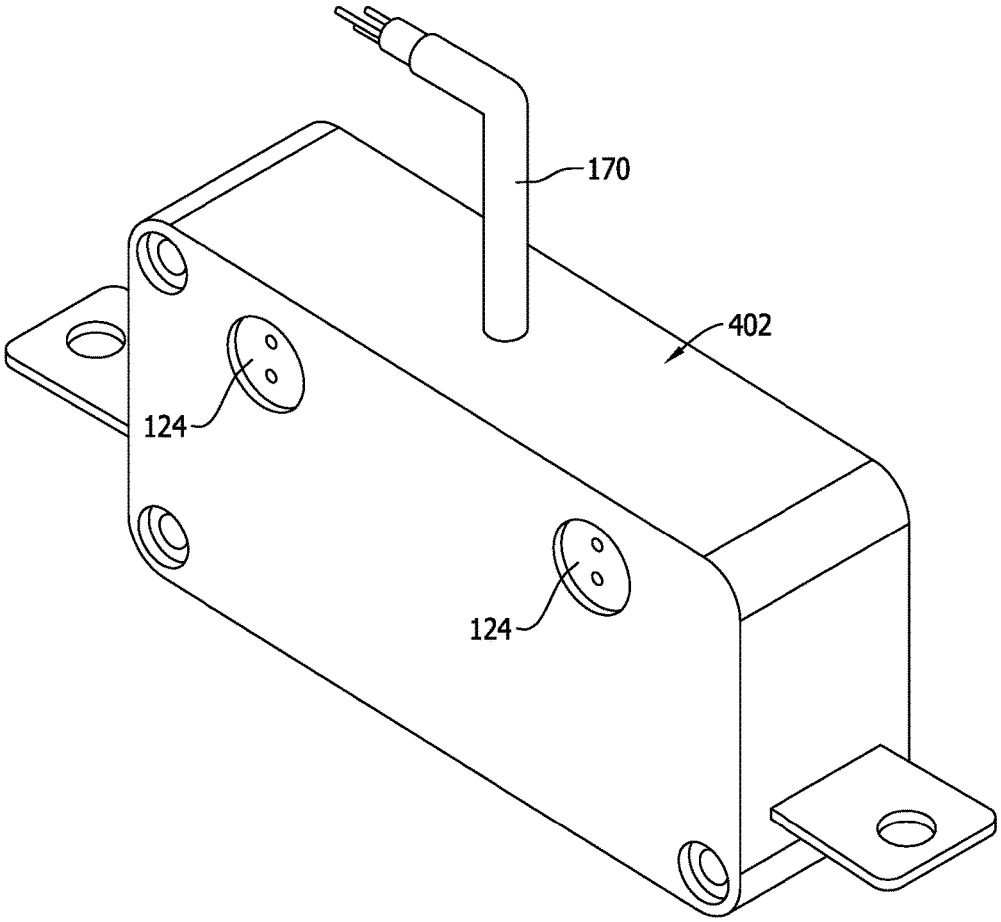
FIG. 9 is a perspective view of the pyrotechnic control module shown in FIG. 8.

The connector 124, 126 of each module 100 in the system 400 is mated with the connector 124, 126 of the adjacent module in each pair of series connected modules 100. As such, the three modules 100 on the left hand side in FIG. 8 are connected to one another via the module connectors 124, 126, and so are the three modules 100 on the right hand side. Each group of three connected modules 100 is further connected to the control module 402, which as shown in FIG. 9, includes two connectors 124 instead of one connector 124 as in the module 140 described above. The module 402 is proportionately larger than the module 140 to span the two groups of modules 100 shown in FIG. 400. The module 402 is functionally similar to module 140 in use to output trigger command signals to activate the disconnect elements 128 in the pyrotechnic disconnect modules 100 when desired. The two connectors 124 in the control module 402 provide dual outputs, one to each group of three connected modules 100 in the system 400.

Like the module 140 described above, the control module 402 either by itself or in response to an incoming signal from the cable 170, may activate the pyrotechnic disconnect modules 100 independently or as a group. While three pyrotechnic disconnect modules 100 are shown in each group, greater or fewer numbers of pyrotechnic disconnect modules 100 may be provided in further and/or alternative embodiments. A housing base and cover similar to those described above in the previous systems may optionally be utilized in the system 400 as desired.

The system 400 also includes an optional arc mitigation fuse 410 that is larger and operable under higher voltage than the fuse 208 in the systems 200, 250, 300 described above, but otherwise serves the same purpose. The system 400 includes bus bar terminals 404, 406 that are larger than the bus bars 204, 206 of the system 200, but are otherwise similar.

Figure 10:
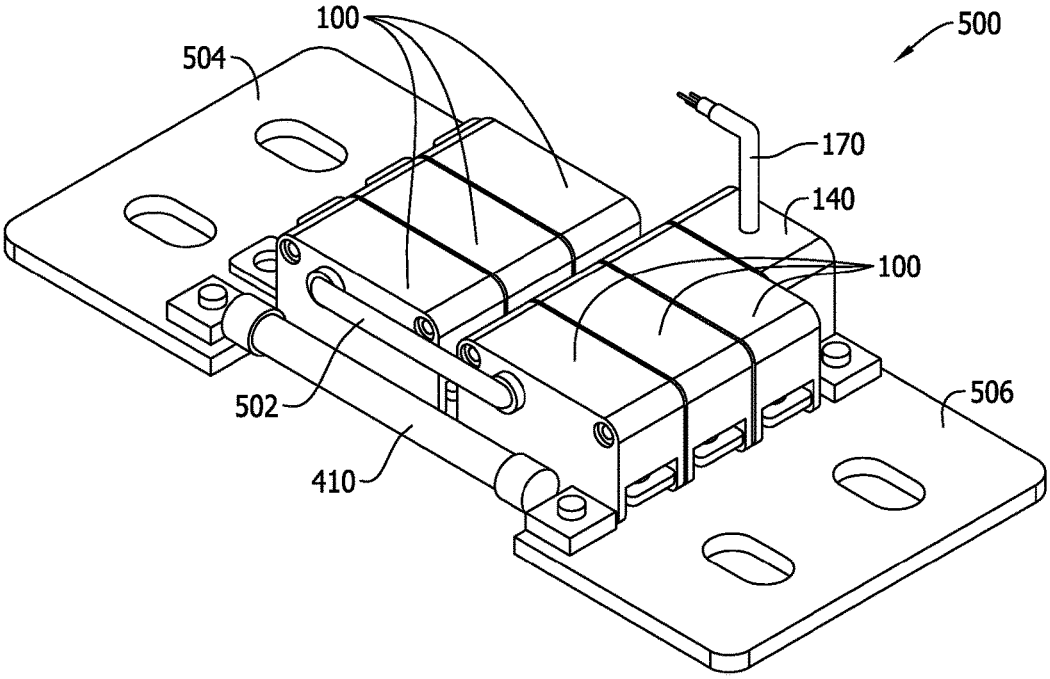
FIG. 10 is a perspective view of a fifth exemplary embodiment of a pyrotechnic circuit protection system according to the present invention including the pyrotechnic circuit protection modules shown in FIGS. 1 and 2 with the pyrotechnic control module shown in FIG. 3.

FIG. 10 is a perspective view of a fifth exemplary embodiment of pyrotechnic circuit protection system 500 according to the present invention.

The system 500 includes series-connected disconnect modules 100 in connected groups of three as in the system 400. Instead of using the dual output control module 402 of the system 400, the system 500 uses the control module 140 connected to one of the groups of modules via the connectors 124, 126, and a jumper element 502 connecting the two groups of connected modules 100 in series with one another for control purposes. The jumper element 502 in contemplated embodiments includes a set of connectors 124 or 126 to facilitate the series connection of the modules 100 as shown.

The control module 140, either by itself or in response to an incoming signal from the cable 170, may activate the pyrotechnic disconnect modules 100 independently or as a group. While three pyrotechnic disconnect modules 100 are shown in each group, greater or fewer numbers of pyrotechnic disconnect modules 100 may be provided in further and/or alternative embodiments.

The system 500 also includes the optional arc mitigation fuse 410. The system 500 includes bus bar terminals 504, 506 that are larger than the bus bars 204, 206 of the system 200, but are otherwise similar. A housing base and cover similar to those described above in the previous systems may optionally be utilized in the system 500 as desired.

Figure 11:
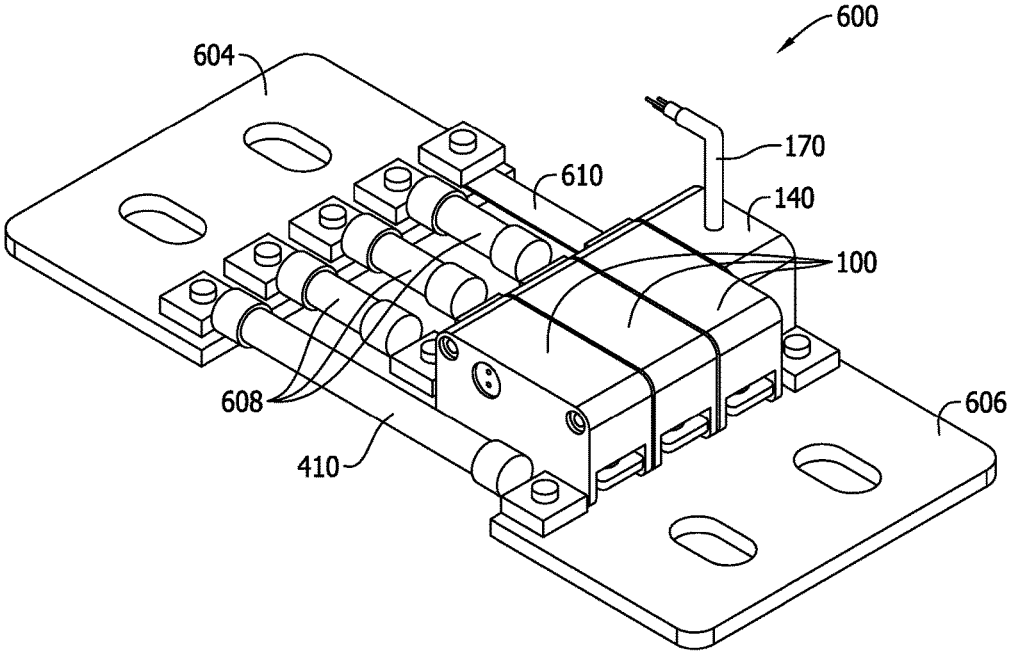
FIG. 11 is a perspective view of a sixth exemplary embodiment of a pyrotechnic circuit protection system according to the present invention including the pyrotechnic circuit protection modules shown in FIGS. 1 and 2 with the pyrotechnic control module shown in FIG. 3.

FIG. 11 is a perspective view of a sixth exemplary embodiment of a pyrotechnic circuit protection system 600 according to the present invention.

The system 600 includes the control module 140 and three pyrotechnic disconnect modules 100 interconnected to one another by the connectors 124, 126. Full voltage and amperage limiters 608 are connected in series with each disconnect module 100 between bus bar terminals 604, 606. The limiters 608 may be current limiting fuses that provide mechanical backup for the control module 140 in an electrical fault condition and/or aid in arc mitigation with the optional arc limiting fuse 410. Other types of current limiters are known, however, and may be utilized for similar purposes. A contact bridge 610 is also shown to connect the control module 140 to the bus bar 604. A housing base and cover similar to those described above in the previous systems may optionally be utilized in the system 600 as desired.

It should now be evident that still further variations of pyrotechnic circuit protection systems may easily be assembled by adding or subtracting disconnect modules and varying the interconnections between them and the other elements described. Having now described the modules 100, 140 and 402, those in the art may construct control circuitry to implement the controls without further explanation. Any programming of a controller may be accomplished using appropriate algorithms and the like to provide the desired effects, which is believed to be within the purview of those in the art.

Relative to existing pyrotechnic circuit protection devices and systems, the pyrotechnic circuit disconnect modules, pyrotechnic control modules and configurable systems including the same facilitate a desirability and expanded use of pyrotechnic disconnect features in at least the following aspects.

The configurable pyrotechnic circuit protection system of the invention readily facilitates the use of pyrotechnic disconnection features in Arcflash Reduction Maintenance Systems (ARMS) now in use in different types of fuse platforms, but not readily compatible with conventional pyrotechnic disconnect devices.

Various different pyrotechnic circuit protection systems of the invention, including but not limited to the examples above, are easily configurable for many applications with a small number of standard modular devices and modular components. A large variety of different systems can be assembled that meet various different needs for particular applications without customization and related expenses and difficulty. The configurable pyrotechnic circuit protection systems of the invention with modular components reduces, if not eliminates, a need to develop a new pyrotechnic disconnect feature for different applications.

The modular pyrotechnic components of the invention provide advantageous economies of scale that reduce costs of providing pyrotechnic disconnect features, as well as simplifies inventories of parts needed to provide a full spectrum of systems for a vast variety of different applications presenting different needs.

The use of pyrotechnic disconnect features in the proposed systems of the invention advantageously facilitates circuit protection systems operable with lower resistance for fusible applications. Consequently, the systems of the invention are operable with lower Watts loss, cooler operation, and improved cycle/fatigue life for fusible applications The proposed pyrotechnic circuit protection systems of the invention facilitate management and coordination of multi-phases of multi-phase power systems, and eliminate undesirable single phase disconnection events in the multi-phase power system.

The built-in control functionality of the pyrotechnic actuation of the invention provides easy and convenient interconnection capability that reduces installation costs and complexity of otherwise individually installed and stand-alone pyrotechnic circuit protection devices. The control functionality of the pyrotechnic actuation provides ease of connection and networking of the proposed configurable pyrotechnic protection systems with other systems (e.g., an arc sensing system as one example). Remote operation of the control functionality of the pyrotechnic protection system is likewise facilitated by interconnection of multiple modular pyrotechnic protection devices to a single control module.

The benefits and advantages of the inventive concepts are now believed to have been amply illustrated in relation to the exemplary embodiments disclosed.

A modular pyrotechnic circuit protection system has been disclosed including at least one pyrotechnic disconnect module. The at least one pyrotechnic disconnect module includes a nonconductive housing including opposed side surfaces, a first electrical connector on one of the opposed side surfaces, a second electrical connector on the other of the opposed side surfaces, a pyrotechnic disconnect element inside the nonconductive housing and electrically connected to at least one of the first and second electrical connectors, and first and second terminals coupled to the housing for connection to external circuitry.

Optionally, the first electrical connector may be a male connector and the second electrical connector may be a female connector. A pass through electrical connection may be established in the housing from the first electrical connector to the second electrical connector. The pyrotechnic element may be configured to release one of chemical energy, electrical energy or mechanical energy to disconnect the first and second terminals. The nonconductive housing may be asymmetrical. The at least one pyrotechnic disconnect module may be in combination with a pyrotechnic control module having at least one electrical connector compatible with one of the first electrical connector and the second electrical connector.

An embodiment of a modular pyrotechnic circuit protection system has also been disclosed including a modular pyrotechnic control module. The modular pyrotechnic control module includes a nonconductive housing comprising opposed side surfaces, at least one electrical connector on one of the opposed side surfaces, a pyrotechnic control circuit inside the nonconductive housing and electrically connected to the at least electrical connector, and first and second terminals coupled to the housing for connection to external circuitry.

Optionally, the at least one electrical connector may be one of a male connector or a female connector. The system may further include a cable for communicating with a remote device. In response to a detected electrical fault condition, the pyrotechnic control circuit outputs a trigger command signal to at least one pyrotechnic disconnect module via the at least one electrical connector. The nonconductive housing may be symmetrical. The pyrotechnic control module of may be in combination with at least one pyrotechnic disconnect module having an electrical connector compatible with the at least one electrical connector. The at least one electrical connector on one of the opposed side surfaces may include a first connector and a second connector on the same one of the opposing side surfaces.

A pyrotechnic circuit protection system has also been disclosed including a first connection terminal, a second connection terminal, and a plurality of pyrotechnic modules connected between the first and second connection terminals, each of the plurality of pyrotechnic modules including a nonconductive housing and electrical connectors facilitating plug-in connection of the pyrotechnic modules to one another.

Optionally, the plurality of pyrotechnic modules includes at least one pyrotechnic disconnect module and a pyrotechnic control module. The plurality of pyrotechnic modules may also include a plurality of pyrotechnic disconnect modules each having a pyrotechnic disconnect element. The plurality of pyrotechnic modules may be connected in parallel between the first connection terminal and the second connection terminal. The plurality of pyrotechnic modules may include pyrotechnic modules connected in series between the first connection terminal and the second connection terminal. The pyrotechnic circuit protection system of may also include at least one of an arc mitigation element connected in parallel to the plurality of pyrotechnic modules or a limiter element connected in series at least some of the plurality of pyrotechnic modules. At least one of the first connection terminal and the second connection terminal may be a bus bar.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A modular pyrotechnic circuit protection system comprising:

a first pyrotechnic disconnect module comprising:

a nonconductive housing including first and second side surfaces opposing one another;

a first electrical connector on the first side surface, the first electrical connector positioned on the first side surface to mechanically and electrically join a mating electrical connector of a second pyrotechnic disconnect module adjacent to the first pyrotechnic disconnect module on the first side surface;

a second electrical connector on the second side surface, the second electrical connector positioned on the second side surface to mechanically and electrically join a mating electrical connector of a third pyrotechnic disconnect module adjacent to the first pyrotechnic disconnect module on the second side surface;

a pyrotechnic disconnect element inside the nonconductive housing and electrically connected to at least one of the first or second electrical connectors; and first and second terminals coupled to the nonconductive housing for connection to external circuitry;

wherein at least one of the second or third pyrotechnic disconnect modules is a pyrotechnic control module communicating a trigger command to the pyrotechnic disconnect element via the first or second electrical connector in response to a detected electrical fault condition.

2. The system of claim 1, wherein the first electrical connector is a male connector and wherein the second electrical connector is a female connector.

3. The system of claim 1, wherein a pass through electrical connection is established in the nonconductive housing from the first electrical connector, through the first pyrotechnic disconnect element, and to the second electrical connector to establish a pass through electrical connection to the mating electrical connector of the third pyrotechnic disconnect module.

4. The system of claim 1, wherein the pyrotechnic disconnect element releases one of chemical energy, electrical energy or mechanical energy to disconnect the first and second terminals from one another.

5. The system of claim 1, wherein the nonconductive housing is asymmetrical.

6. The system of claim 1, in combination with the pyrotechnic control module.

7. The system of claim 1, wherein the first and second electrical connectors are in-line with one another on the first and second side surfaces.

8. The system of claim 1, wherein the first electrical connector includes first and second prongs and wherein the second electrical connector includes first and second apertures.

9. The system of claim 8, wherein the first prong establishes a control connection to the pyrotechnic disconnect element, and wherein the second prong establishes a pass through electrical connection to the second pyrotechnic disconnect module.

10. A modular pyrotechnic circuit protection system comprising:

a modular pyrotechnic control module comprising:

a nonconductive housing comprising first and second side surfaces opposing one another;

an electrical connector exposed on the first or second side surface;

a pyrotechnic control circuit inside the nonconductive housing and electrically connected to the electrical connector;

wherein the electrical connector is located to mechanically and electrically join an aligned electrical connector provided on a mating pyrotechnic disconnect module including a pyrotechnic disconnect element;

wherein the mating pyrotechnic disconnect module is separately provided from but adjacent to the modular pyrotechnic control module and wherein the aligned electrical connector establishes a plug-in control connection to the electrical connector of the modular pyrotechnic control module;

wherein the pyrotechnic control circuit communicates, via the plug-in control connection, a trigger command that activates the pyrotechnic disconnect element in the mating pyrotechnic disconnect module; and first and second terminals coupled to the nonconductive housing for connection to external circuitry.

11. The system of claim 10, wherein the electrical connector is a male connector or a female connector.

12. The system of claim 10, further comprising a cable coupled to the modular pyrotechnic control module and establishing communication with a remote device.

13. The system of claim 10, wherein in response to a detected electrical fault condition, the pyrotechnic control circuit outputs the trigger command signal.

14. The system of claim 10, wherein the nonconductive housing is symmetrical.

15. The system of claim 10, in combination with the mating pyrotechnic disconnect module.

16. A pyrotechnic circuit protection system comprising:

a first connection terminal;

a second connection terminal;

a plurality of side-by-side pyrotechnic modules connected in parallel to one another between the first and second connection terminals, each of the plurality of side-by-side pyrotechnic modules including a nonconductive housing and respective electrical connectors facilitating plug-in mechanical and electrical interconnection of the side-by-side pyrotechnic modules to one another; and an arc mitigation fuse separately provided from the plurality of side-by-side pyrotechnic modules and connected between the first and second connection terminals in parallel to the plurality of side-by-side pyrotechnic modules.

17. The pyrotechnic circuit protection system of claim 16, wherein the plurality of side-by-side pyrotechnic modules includes at least one pyrotechnic disconnect module including a pyrotechnic disconnect element and a pyrotechnic control module generating a trigger command that activates the pyrotechnic disconnect element in the mating pyrotechnic disconnect module in response to a detected electrical fault condition, wherein the at least one pyrotechnic disconnect element and the pyrotechnic control module are mechanically and electrically engaged to one another via the respective electrical connectors.

18. The pyrotechnic circuit protection system of claim 16, wherein the plurality of side-by-side pyrotechnic modules includes a plurality of pyrotechnic disconnect modules each having a pyrotechnic disconnect element therein, the plurality of side-by-side pyrotechnic modules mechanically and electrically engaged to one another via the respective electrical connectors.

19. The pyrotechnic circuit protection system of claim 16, further comprising a limiter element connected in series with at least some of the plurality of side-by-side pyrotechnic modules.

20. The pyrotechnic circuit protection system of claim 16, wherein at least one of the first connection terminal and the second connection terminal is a bus bar.

21. The pyrotechnic circuit protection system of claim 16, wherein the plurality of side-by-side pyrotechnic modules includes a plurality of pyrotechnic disconnect modules and a pyrotechnic control module mechanically and electrically engaged to one another via the respective electrical connectors, wherein the pyrotechnic control module is operative to activate the plurality of pyrotechnic disconnect modules individually or simultaneously.

* * * * *